US009085936B2

(12) United States Patent
Mosier

(10) Patent No.: US 9,085,936 B2
(45) Date of Patent: Jul. 21, 2015

(54) LADDER SUPPORT DEVICE

(76) Inventor: William R. Mosier, Lexington, SC (US)

( * ) Notice: Subject to any disclaimer, the term of this patent is extended or adjusted under 35 U.S.C. 154(b) by 453 days.

(21) Appl. No.: 13/423,367

(22) Filed: Mar. 19, 2012

(65) Prior Publication Data

US 2013/0240687 A1 Sep. 19, 2013

(51) Int. Cl.

| | |
|---|---|
| ***A47B 43/00*** | (2006.01) |
| ***E06C 5/04*** | (2006.01) |
| *E06C 1/397* | (2006.01) |
| *E06C 7/42* | (2006.01) |

(52) U.S. Cl.

CPC . *E06C 5/04* (2013.01); *E06C 1/397* (2013.01); *E06C 7/423* (2013.01)

(58) Field of Classification Search

CPC ..... A47F 5/10; A47F 5/12; E06C 7/00; E06C 7/42; E06C 7/423; E06C 9/12; E06C 5/04; E06C 1/397

USPC ..... 211/198; 182/180.2, 180.3, 156, 116, 182/127, 152, 204

See application file for complete search history.

(56) References Cited

U.S. PATENT DOCUMENTS

| | | | | | |
|---|---|---|---|---|---|
| 141,126 | A | * | 7/1873 | Eagon | 182/180.3 |
| 292,932 | A | * | 2/1884 | Markwick | 182/16 |
| 1,241,486 | A | * | 10/1917 | Armstrong | 211/17 |
| 1,381,397 | A | | 6/1921 | Briles | |
| 2,043,516 | A | | 7/1936 | Johnson | |
| 3,327,810 | A | | 6/1967 | Johnson et al. | |
| 3,734,494 | A | * | 5/1973 | Sellner | 482/142 |
| 5,085,329 | A | * | 2/1992 | Crowell et al. | 211/195 |
| 5,701,701 | A | * | 12/1997 | Desrosiers | 49/116 |
| 5,857,544 | A | * | 1/1999 | Del Sole | 182/180.3 |
| 5,960,906 | A | * | 10/1999 | Henderson | 182/180.2 |
| 6,053,284 | A | | 4/2000 | Fountain | |
| 6,250,425 | B1 | | 6/2001 | Barnes et al. | |
| 7,614,480 | B2 | | 11/2009 | Smiley | |
| 7,740,106 | B2 | * | 6/2010 | Vetesnik | 182/141 |
| 2006/0169536 | A1 | * | 8/2006 | Davis | 182/127 |
| 2007/0272633 | A1 | * | 11/2007 | Gardner et al. | 211/41.15 |
| 2008/0217501 | A1 | * | 9/2008 | Jensen | 248/460 |
| 2012/0007343 | A1 | * | 1/2012 | Webster et al. | 280/659 |

* cited by examiner

*Primary Examiner* — Korie H Chan

(74) *Attorney, Agent, or Firm* — Nelson Mullins Riley & Scarborough, LLP

(57) ABSTRACT

A support device for a ladder. The support device comprises a first support frame coupled with the base portion and a second support frame coupled with the base portion. Each of the first and support frames comprise a top portion and a pair of elongate stiles. The first support frame and the second support frame are each pivotable relative to the base portion between a stored position and an extended position. In the extended position, the first support frame top portion is releasably connected to the second support frame top portion. The support device also comprises a tether arrangement operative to disconnect the first support frame from the second support frame such that the first and second support frames may be pivoted to the stored position.

16 Claims, 18 Drawing Sheets

LADDER SUPPORT DEVICE

FIELD OF THE INVENTION

The present invention relates generally to devices for supporting a ladder. More specifically, the present invention relates to a collapsible ladder support device comprising dual support frames, each pivotally connected to a base and releasably connected to each other at top portions thereof.

BACKGROUND OF THE INVENTION

By way of background, various types of ladders are known. Self-sustaining ladders, such as step ladders, do not require support to remain upright. In contrast, non-self-sustaining ladders require support to remain upright. An extension ladder, for example, is often leaned against a wall or roof for support.

Self-sustaining ladders are often unwieldy and cumbersome for reaching high areas. For example, as the height of a self-sustaining ladder increases, its "footprint" increases proportionately, thus taking up a large amount of space. Although non-self-sustaining ladders are useful for reaching such high areas, situations often arise wherein there is not a vertical support against which the non-self-sustaining ladder can rest. This may be the case, for example, where it is necessary to reach a lamp or fan at the apex of a vaulted ceiling. Further, non-self-sustaining ladders may be unstable and may experience bowing when used to reach high areas.

SUMMARY

The present invention recognizes and addresses disadvantages of prior art constructions and methods. According to one embodiment, the present invention provides a support device for a ladder. The support device comprises a base portion, a first support frame comprising a proximal end and a distal end, and a second support frame comprising a proximal end and a distal end. The first support frame is pivotally connected to the base portion at the first support frame proximal end, and the second support frame is pivotally connected to the base portion at the second support frame proximal end. The first support frame distal end is releasably connectable with the second support frame distal end. Finally, the support device comprises a tether arrangement coupled to one of the first and second support frame distal ends for disconnecting the first and second support frames.

According to a further embodiment, the present invention provides a support device for a ladder. The support device comprises a first support frame coupled with the base portion and a second support frame coupled with the base portion. Each of the first and support frames comprise a top portion and a pair of elongate stiles. The first support frame and the second support frame are each pivotable relative to the base portion between a stored position and an extended position. In the extended position, the first support frame top portion is releasably connected to the second support frame top portion. The support device also comprises a tether arrangement operative to disconnect the first support frame from the second support frame such that the first and second support frames may be pivoted to the stored position.

Those skilled in the art will appreciate the scope of the present invention and realize additional aspects thereof after reading the following detailed description of preferred embodiments in association with the accompanying drawing figures.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
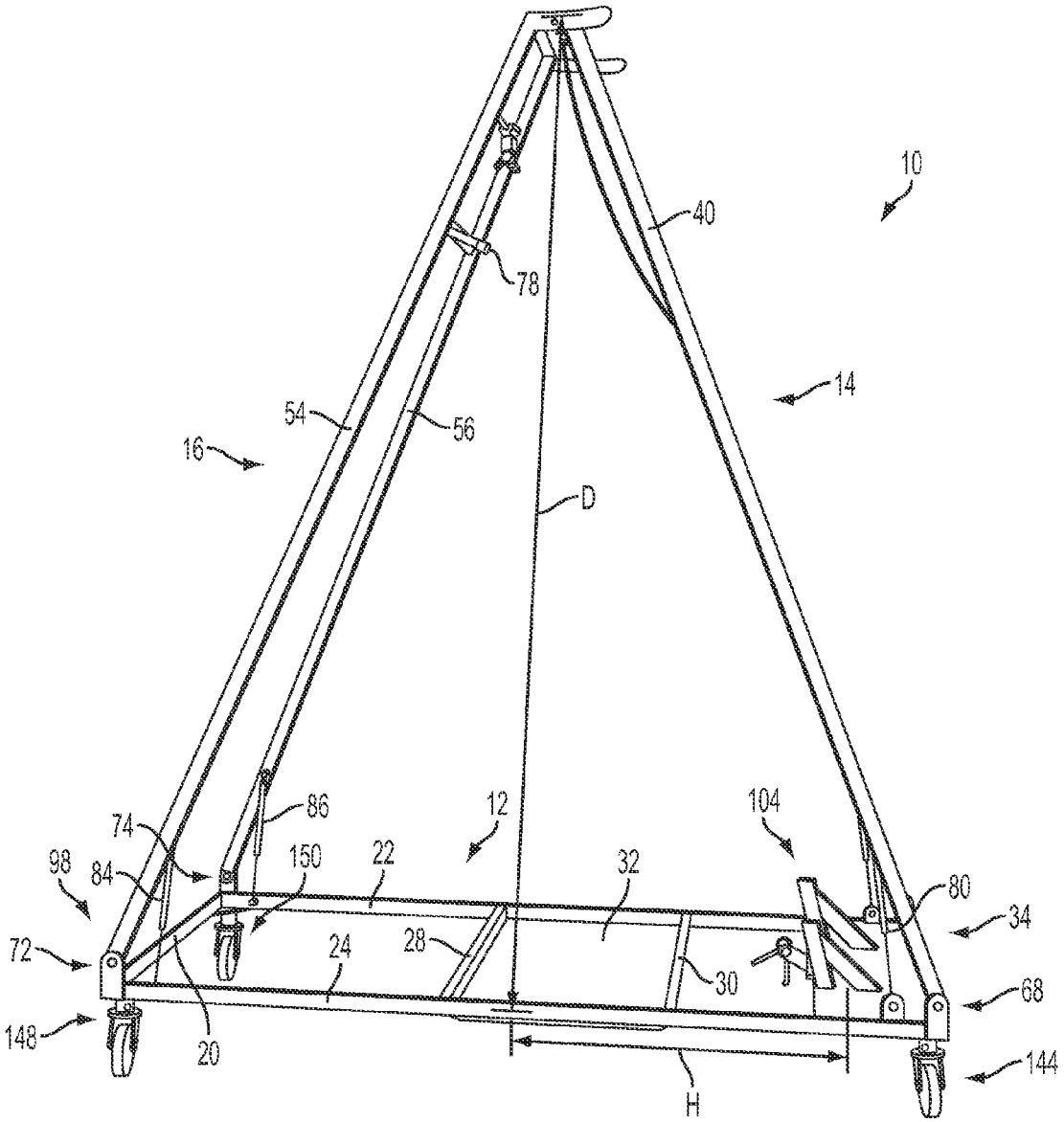
FIG. 1 is a side view of a ladder support device constructed in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

In general, embodiments of the present invention relate to a ladder support device for a non-self-sustaining ladder. As used herein, the term "non-self-sustaining ladder" is used broadly to refer to portable ladders which are typically leaned against a vertical support during use. In one example, a non-self-sustaining ladder which may be used with the present invention may be an extension ladder having any duty rating. However, those of skill in the art will appreciate that the present invention is not so limited.

Figure 2:
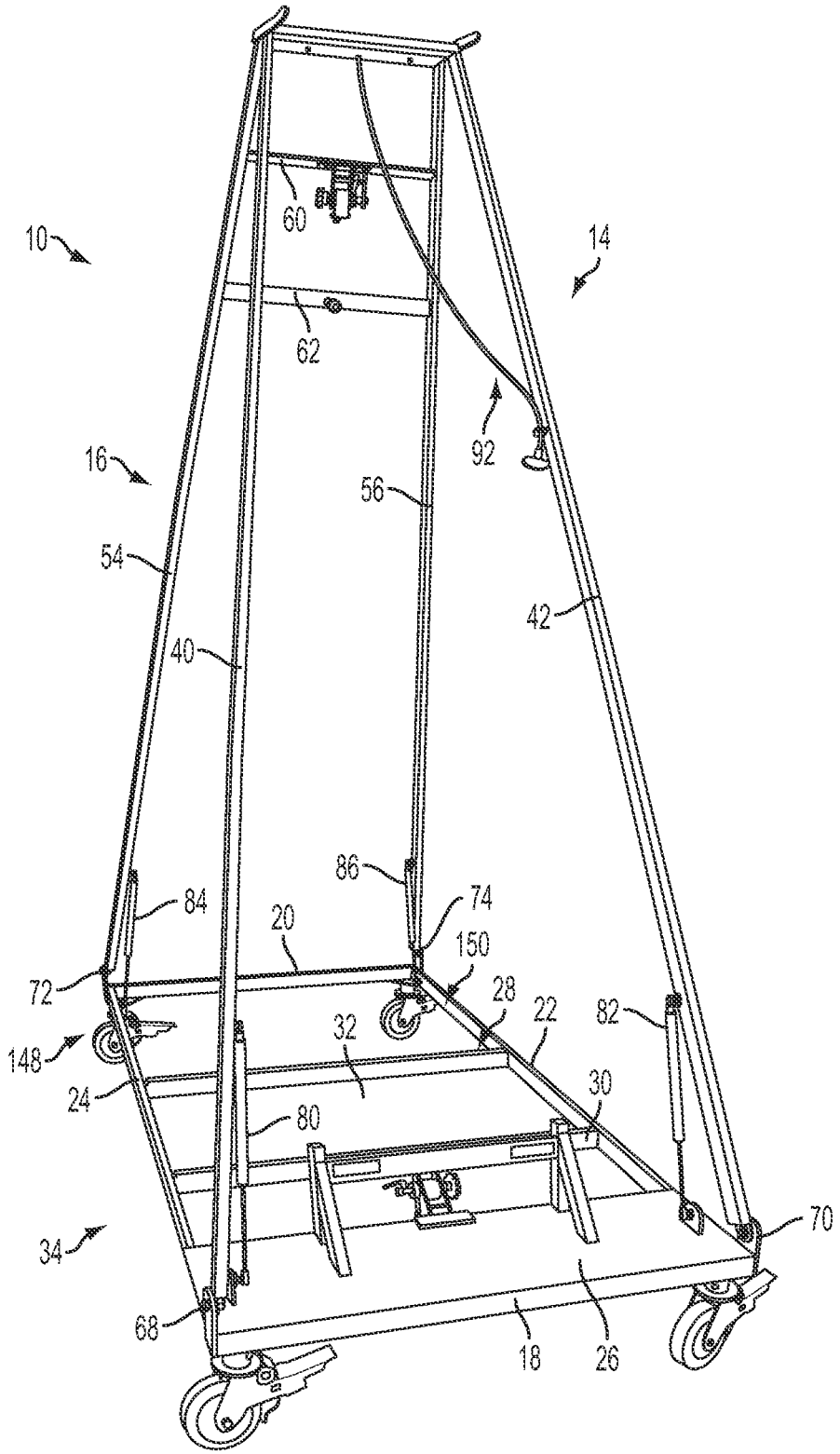
FIG. 2 is a front perspective view of the ladder support device of FIG. 1.
Figure 3:
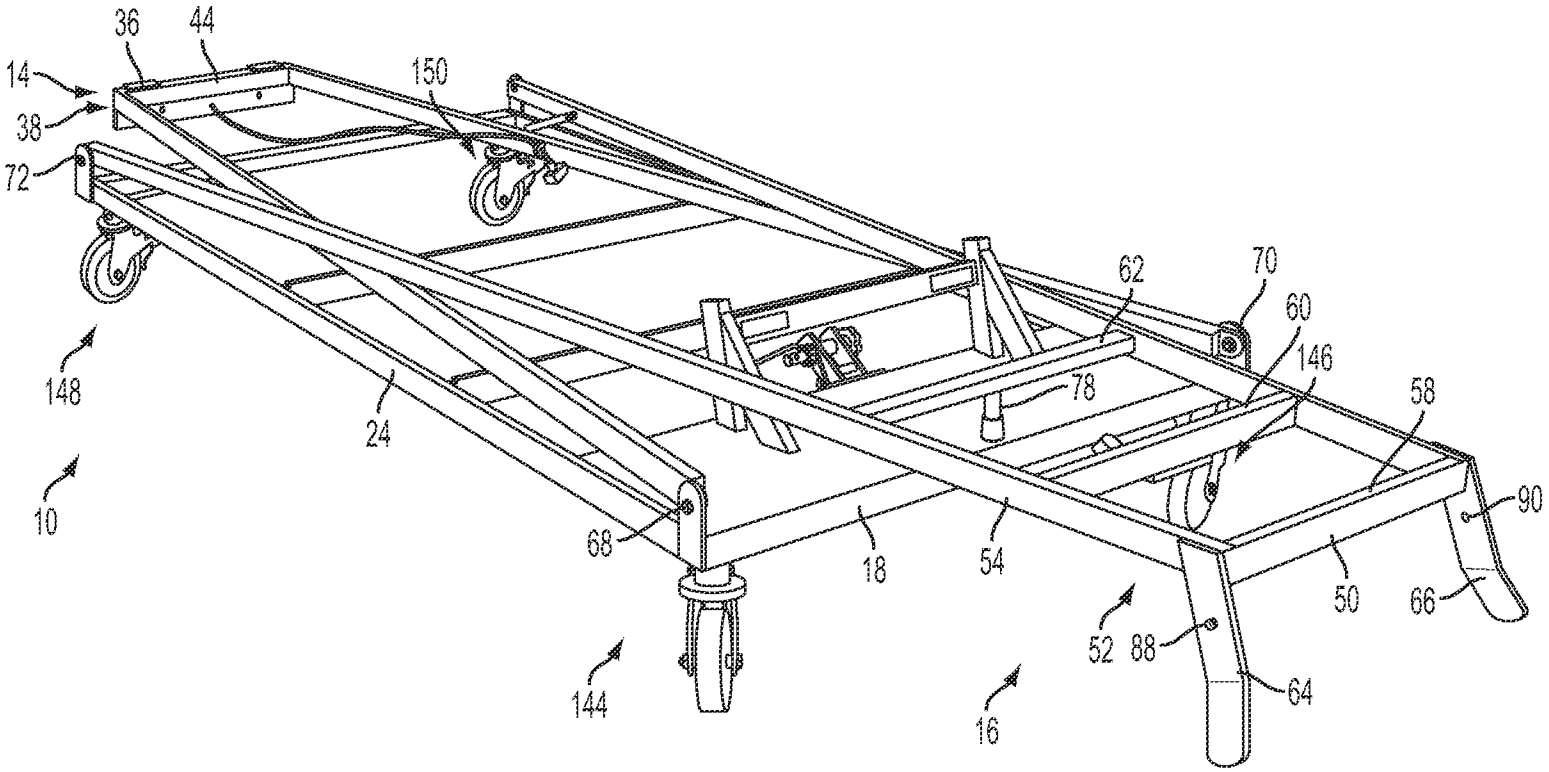
FIG. 3 is a front perspective view of the ladder support device of FIG. 1 shown in a stored position.
Figure 4:
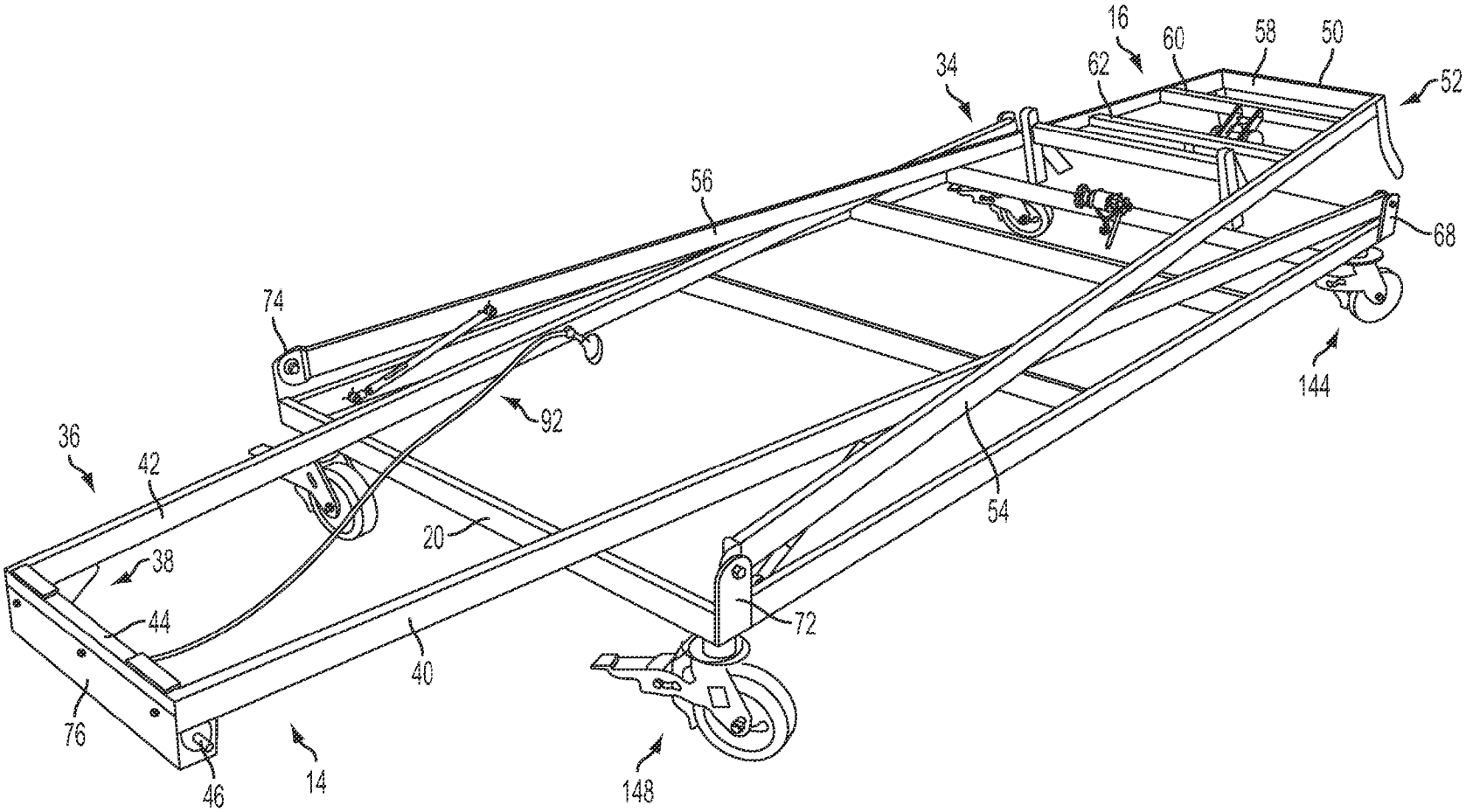
FIG. 4 is a rear perspective view of the ladder support device of FIG. 1 shown in a stored position.
Figure 5:
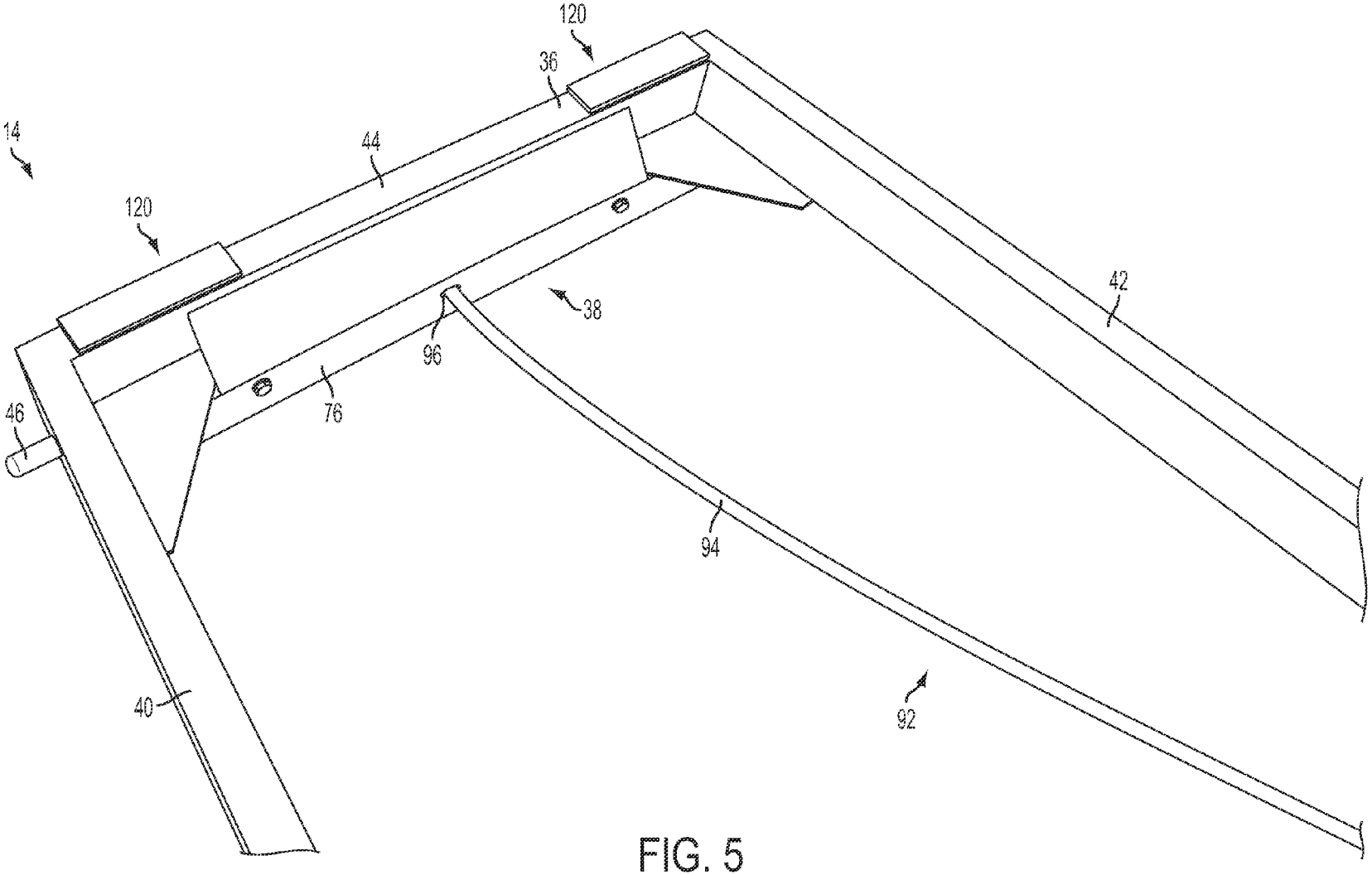
FIGS. 5 and 6 are enlarged perspective views of a first support frame of the ladder support device of FIG. 1.

According to one embodiment, a ladder support device 10 for supporting a non-self-sustaining ladder is shown in an extended, or "A-frame," position in FIGS. 1-2 and in a stored, or collapsed, position in FIGS. 3-5. Referring to the Figures, ladder support device 10 may comprise a base portion 12 and first and second support frames 14, 16 pivotably coupled with base portion 12. Base portion 12 and first and second support frames 14, 16 may preferably be constructed of a high-strength lightweight material, such as steel tubing. When attached to base portion 12, support frames 14, 16 may each preferably resemble an isosceles trapezoid.

More particularly, base portion 12 may comprise an open rectangular frame comprising a front member 18 and a rear member 20 welded at right angles to parallel side members 22, 24. It will be appreciated, however, that base portion 12 need not be rectangular in all embodiments. Additionally, base portion 12 may comprise a horizontal platform 26 welded over a portion of side members 22, 24 and front member 18. Base portion 12 may further comprise a pair of support members 28, 30 coupled perpendicularly between side members 22, 24. Support members 28 and 30 may be spaced apart by a predetermined distance and configured to receive a removable tool tray 32. Tool tray 32 may be used to carry tools, a generator, or any other items desired to be transported with ladder support device 10.

First support frame 14 may have a proximal end 34 and a distal end 36 and comprise a top portion 38 and a pair of elongate stiles 40, 42. At distal end 36, top portion 38 may comprise a horizontal member 44 coupled between elongate stiles 40, 42. As described in more detail below, a pair of spring-loaded pins 46 may be coupled with horizontal member 44. Each pin 46, which may be biased laterally outward by its respective spring, may extend along an axis parallel with the longitudinal axis of horizontal member 44.

Second support frame 16 may have a proximal end 48 and a distal end 50 and comprise a top portion 52 and a pair of elongate stiles 54, 56. At distal end 50, top portion 52 may comprise a horizontal member 58 coupled between elongate stiles 54, 56. Additionally, second support frame 16 may comprise first and second support members 60, 62 extending between elongate stiles 54, 56. As shown in FIGS. 3 and 4, top portion 52 may also comprise arms 64, 66 which are coupled with and project outward from elongate stiles 54, 56. Arms 64, 66 are preferably disposed on second support frame 16 such that they extend substantially parallel with the plane in which bottom portion 12 lies when ladder support device 10 is in the extended position.

Notably, embodiments of the present invention provide a ladder support device which may be readily collapsible for storage and transport. In particular, first support frame 14 may be pivotably coupled with base portion 12 via hinges 68, 70 operatively connected between elongate stiles 40, 42, respectively, and base portion 12. Hinges 68, 70 are preferably respectively positioned proximate a first corner of base portion 12 defined by the junction between side member 24 and front member 18 and a second corner of base portion 12 defined by the junction between side member 22 and front member 18. Similarly, second support frame 16 may be pivotably coupled with base portion 12 via hinges 72, 74 operatively connected between elongate stiles 54, 56, respectively, and base portion 12. Hinges 72, 74 are preferably respectively positioned proximate a third corner of base portion 12 defined by the junctions between side member 24 and rear member 20 and a fourth corner of base portion 12 defined by the junction between side member 22 and rear member 20. In the illustrated embodiment, hinges 68, 70, 72, and 74 may comprise a bolt with a partially threaded shank which receives a nut, but any suitable hinge may be used with the present invention. By way of hinges 68, 70, 72, and 74, first and second support frames 14 and 16 may be pivoted between their stored and extended positions.

A U-shaped sheath 76 may be coupled over spring-loaded pins 46 on horizontal member 44 of first support frame 14 to provide a surface for contact between first support frame 14 and first horizontal member 58 of second support frame 16 when ladder support device 10 is in the extended position. Additionally, a stopper 78 may be centered on and project from support member 62 along an axis perpendicular to the plane in which elongate stiles 54, 56 lie. Stopper 78 may comprise a length of round steel tubing having a rubber cap on its distal end configured to support second support frame 16 on base portion 12 when ladder support device 10 is in the stored position (see FIG. 3).

To reduce the effort required to raise and lower each support frame 14, 16, at least one pneumatic cylinder may be provided between base portion 12 and each support frame 14, 16. In a preferred embodiment, two pneumatic cylinders are provided between each support frame 14, 16 and base portion 12. For example, as shown in the Figures, for first support frame 14, a pneumatic cylinder 80 may be coupled between side member 24 and elongate stile 40, and a pneumatic cylinder 82 may be coupled between side member 22 and elongate stile 42. Likewise, for second support frame 16, a pneumatic cylinder 84 may be coupled between side member 24 and elongate stile 54, and a pneumatic cylinder 86 may be coupled between side member 22 and elongate stile 56. Thereby, a single user may readily move support frames 14, 16 between stored and extended positions.

As shown in FIGS. 3 and 4, in the stored position, first support frame 14 may lie flat against rear member 20 of base portion 12, and second support frame 16 may lie over first support frame 16, supported slightly above base portion 12 by stopper 78. In use, to move ladder support device 10 into the extended position, a user may first raise second support frame 16 to a substantially vertical position and second raise first support frame 14 to a substantially vertical position. Second support member 62 of second support frame 16 is preferably positioned between elongate stiles 54, 56 at a height which allows distal end 36 of first support frame 14 to pass thereunder as first support frame 14 is being raised.

The user may then lower first and second support frames 14, 16 toward each other to connect support frames 14, 16 at their respective distal ends 36, 50. More particularly, arms 64, 66 of second support frame 16 preferably each define an aperture 88, 90 therethrough configured such that laterally-extending spring-loaded pins 46 of first support frame 14 register therewith. The distal ends of arms 64, 66 may be angled laterally outward to receive and compress pins 46 as pins 46 travel along arms 64, 66 toward apertures 88, 90 and when top portion 38 of first support frame 14 is brought into contact with top portion 52 of second support frame 16. When pins 46 register with apertures 88, 90, pins 46 preferably extend outward under the force of their springs to lock first and second support frames 14, 16 together. In this extended position, ladder support device 10 may define a vertical dimension D between top portions 38, 52 of first and second support frames 14, 16 and base portion 12 (see FIG. 1).

Figure 6:
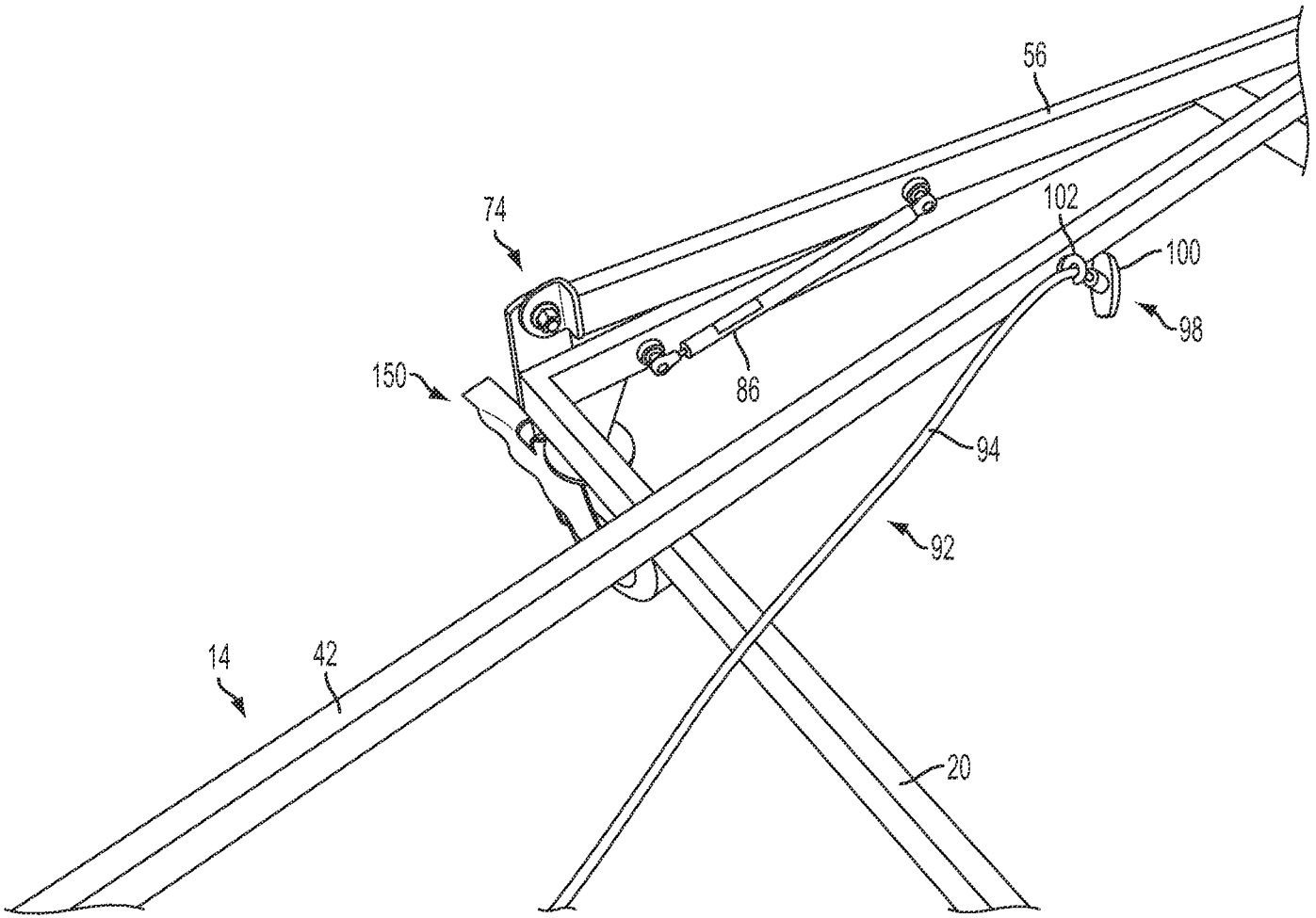

Notably, ladder support device 10 preferably comprises a tether arrangement 92 operative to disconnect first and second support frames 14, 16 and move ladder support device 10 into the stored position. Tether arrangement 92 may be coupled with the support frame to which the spring-loaded pins are coupled, which in this embodiment is first support frame 14. More particularly, and referring also to FIGS. 5 and 6, tether arrangement 92 preferably comprises an elongate tether 94 which is operatively connected with spring-loaded pins 46 via an aperture 96 in sheath 76. Tether 94 may comprise an elongate metal wire covered by plastic tubing. Tether 94 preferably defines a free end 98 to which a handle 100 may be coupled. An elongate stile of first support frame 14, such as elongate stile 42 in this embodiment, may define a hook 102 to releasably retain tether 94 when ladder support device 10 is in use (see also FIGS. 1-2).

The length of tether 94 is preferably such that a user may reach handle 100 at hook 102 and actuate tether arrangement 92 while standing on the ground or floor. To actuate tether arrangement 92, a user may remove tether 94 from hook 102 and grasp handle 100. Then, the user may pull downward on tether 94. Because tether 94 is operatively connected with pins 46, this downward motion causes pins 46 to retract from apertures 88, 90. As a result, the user may then move first and second support frames 14, 16 apart from one another. Finally, after securing tether 94 in hook 102, the user may lower first support frame 14 to rest on base portion 12 and then lower second support frame 16 over first support frame 14 to also rest on base portion 12 via stopper 78.

Referring also to FIGS. 7-11, to support a non-self-sustaining ladder on ladder support device 10, ladder support device 10 may comprise a stabilizing bracket 104. Stabilizing bracket 104, which as shown is coupled with horizontal platform 26, preferably facilitates placement of the ladder at a safe angle and stabilizes the ladder when the ladder is in use. For example, stabilizing bracket 104 may comprise two lateral support members 106, 108 which project perpendicularly from horizontal platform 26. A horizontal brace 110 may be coupled between lateral support members 106, 108 parallel with but spaced apart from base portion 12.

Figure 8:
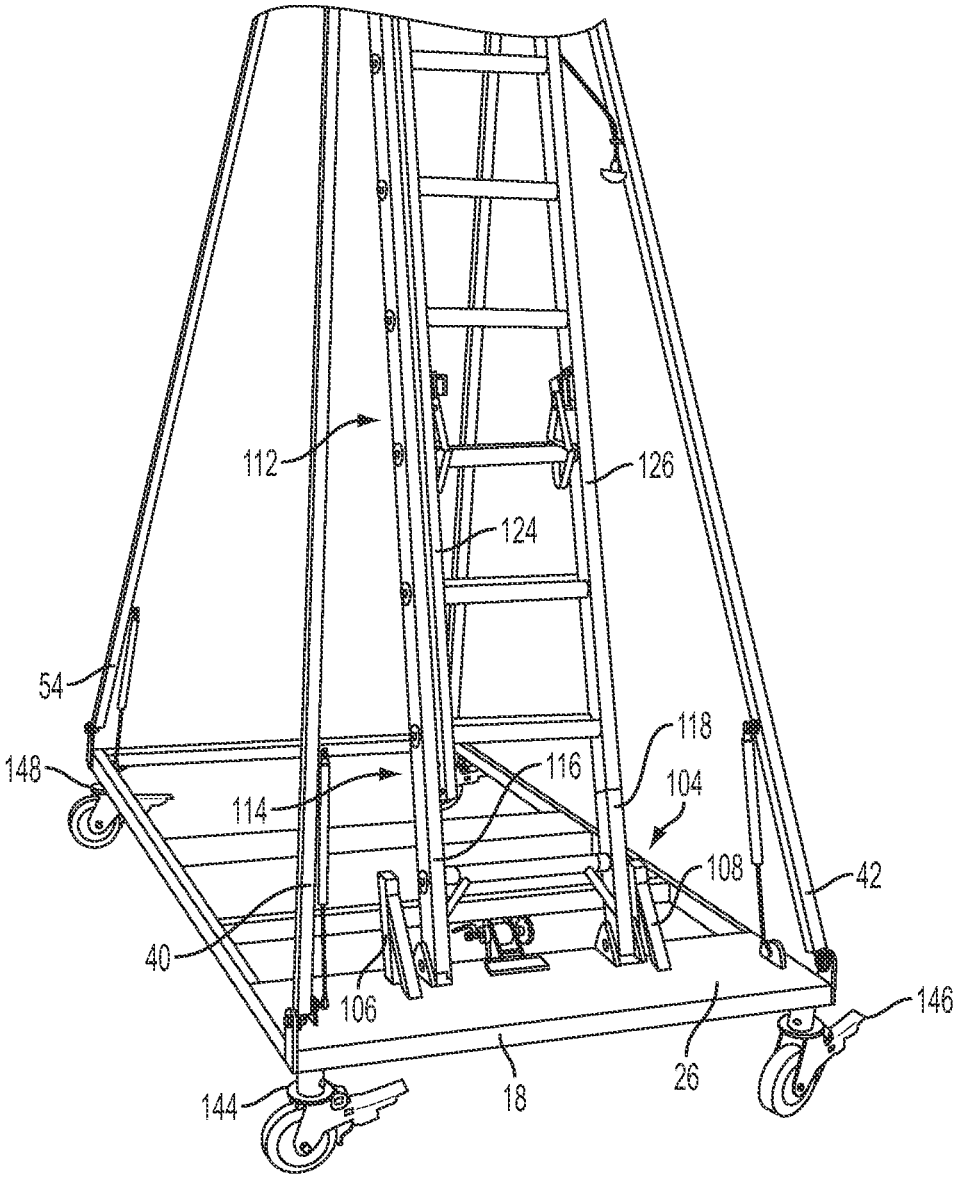
FIG. 8 is an enlarged perspective view of the base of the ladder support device of FIG. 1 wherein the ladder support device is used to support an extension ladder.

As shown in FIG. 8, the feet of a non-self-sustaining ladder 112 may be placed on platform 26 between lateral support members 106, 108. Ladder 112 comprises a base section 114, the parallel rails 116, 118 of which lean against horizontal brace 110. In this embodiment, lateral support members 106, 108 may be triangular and extend forward a predetermined distance from a distal edge 119 of horizontal platform 26 toward front member 18 of base portion 12 to restrict lateral movement of the feet of ladder 112 during use. In other embodiments, however, it will be appreciated that lateral support members 106, 108 may define any suitable shape. There may be a horizontal dimension H between the position of the feet of a ladder in stabilizing bracket 104 and the center of base portion 12, as illustrated in FIG. 1.

Figure 7:
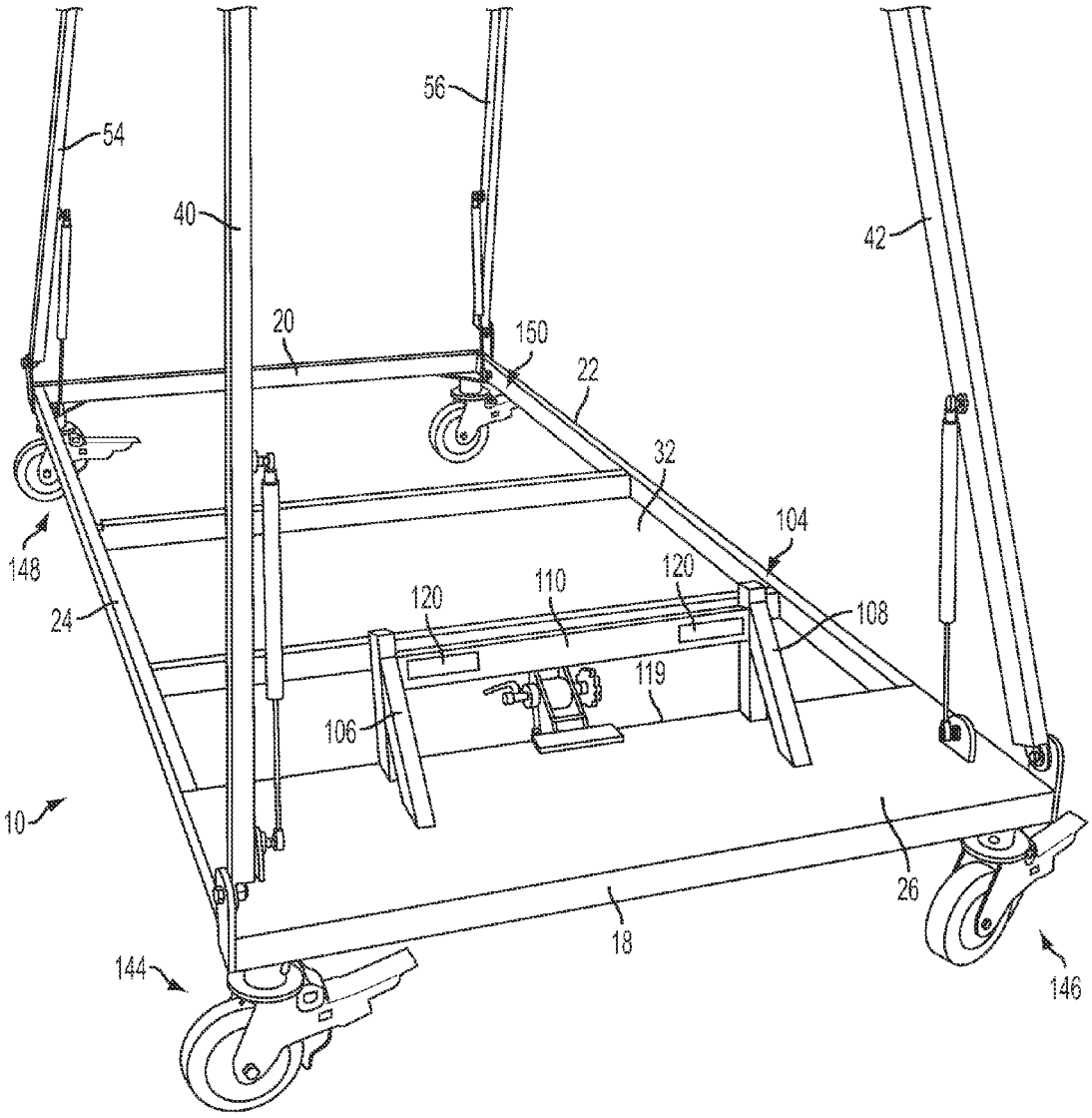
FIG. 7 is an enlarged perspective view of the base of the ladder support device of FIG. 1.
Figure 9:
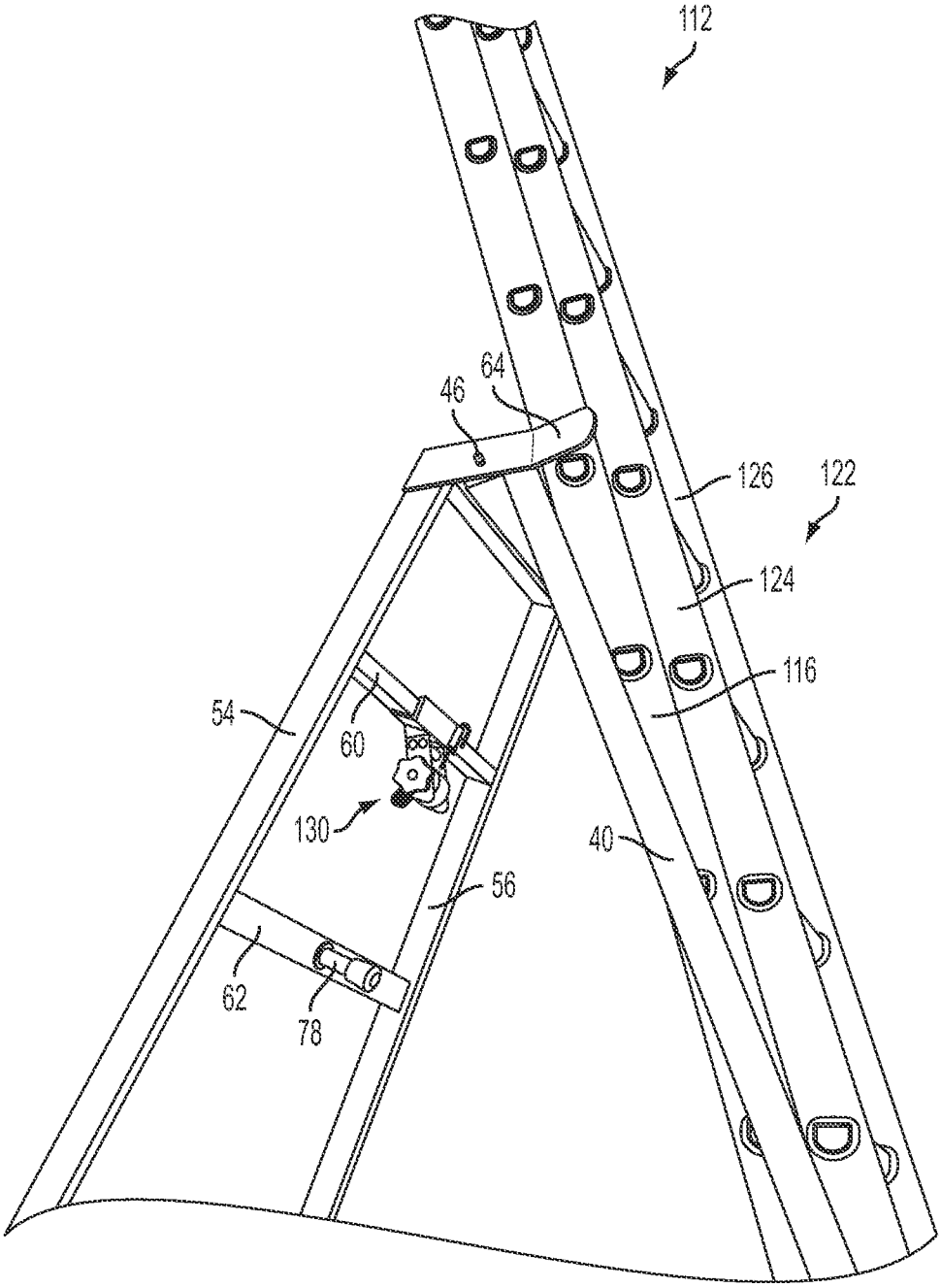
FIG. 9 is an enlarged perspective view of the top portions of the first and second support frames of the ladder support device of FIG. 8.
Figure 10:
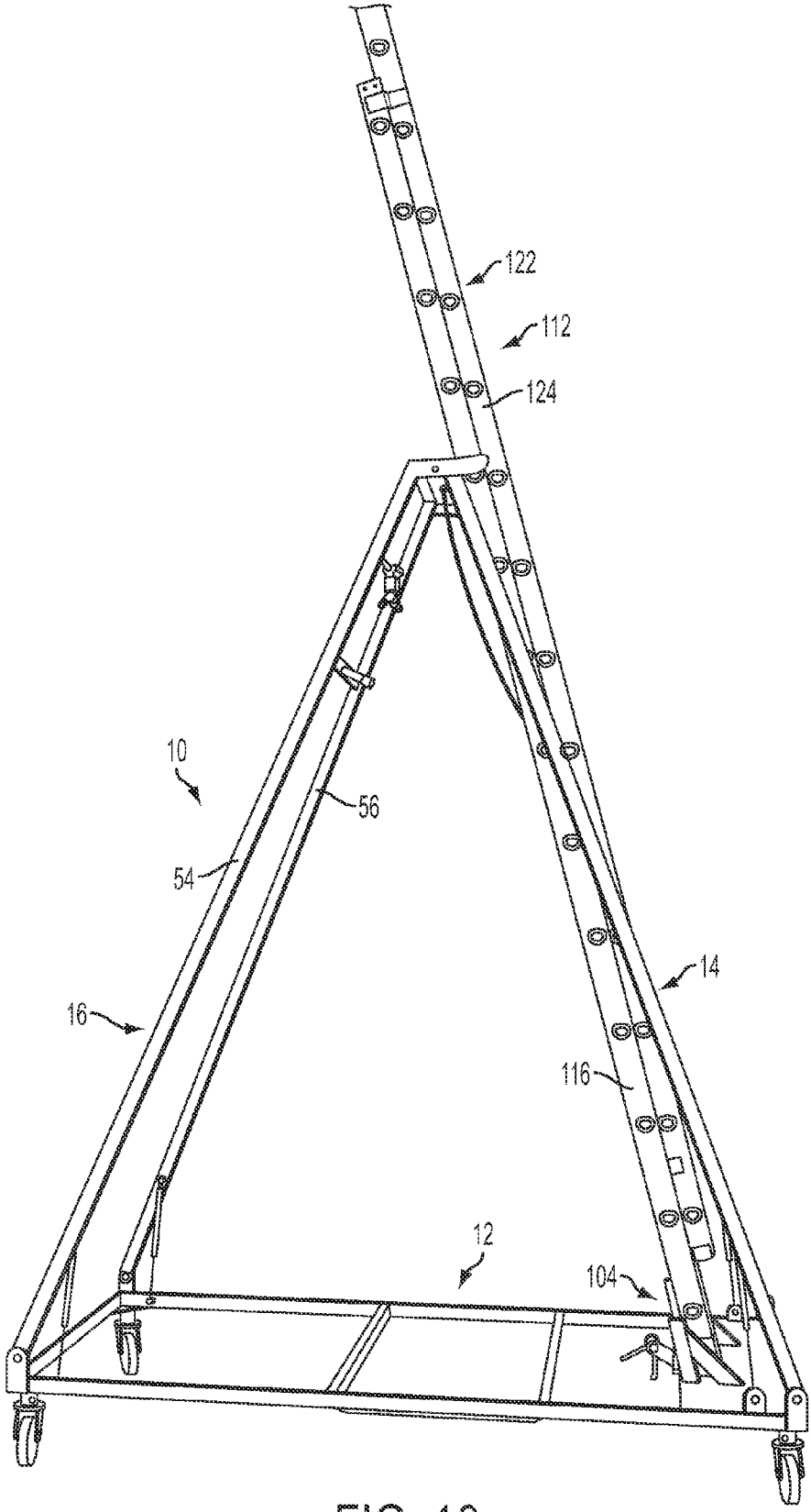
FIG. 10 is a side view of the ladder support device of FIG. 8.
Figure 11:
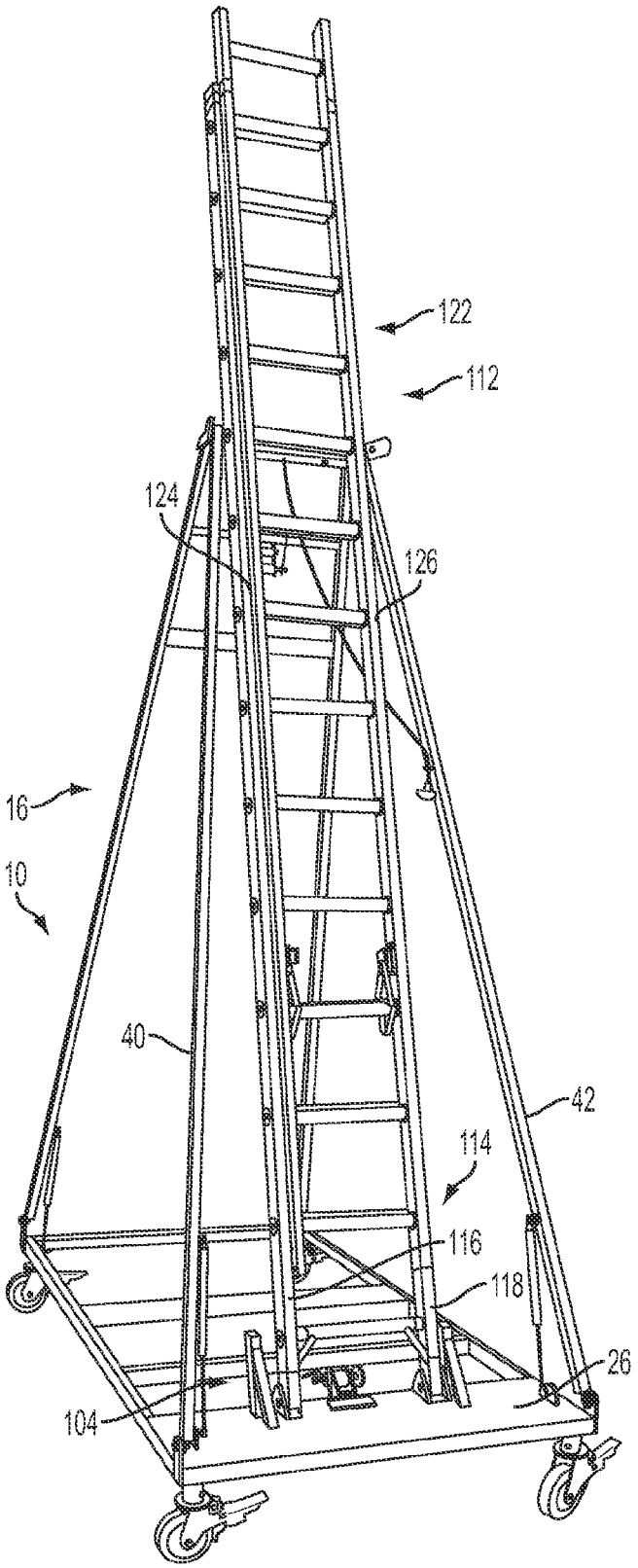
FIG. 11 is a front view of the ladder support device of FIG. 8.
Figure 12:
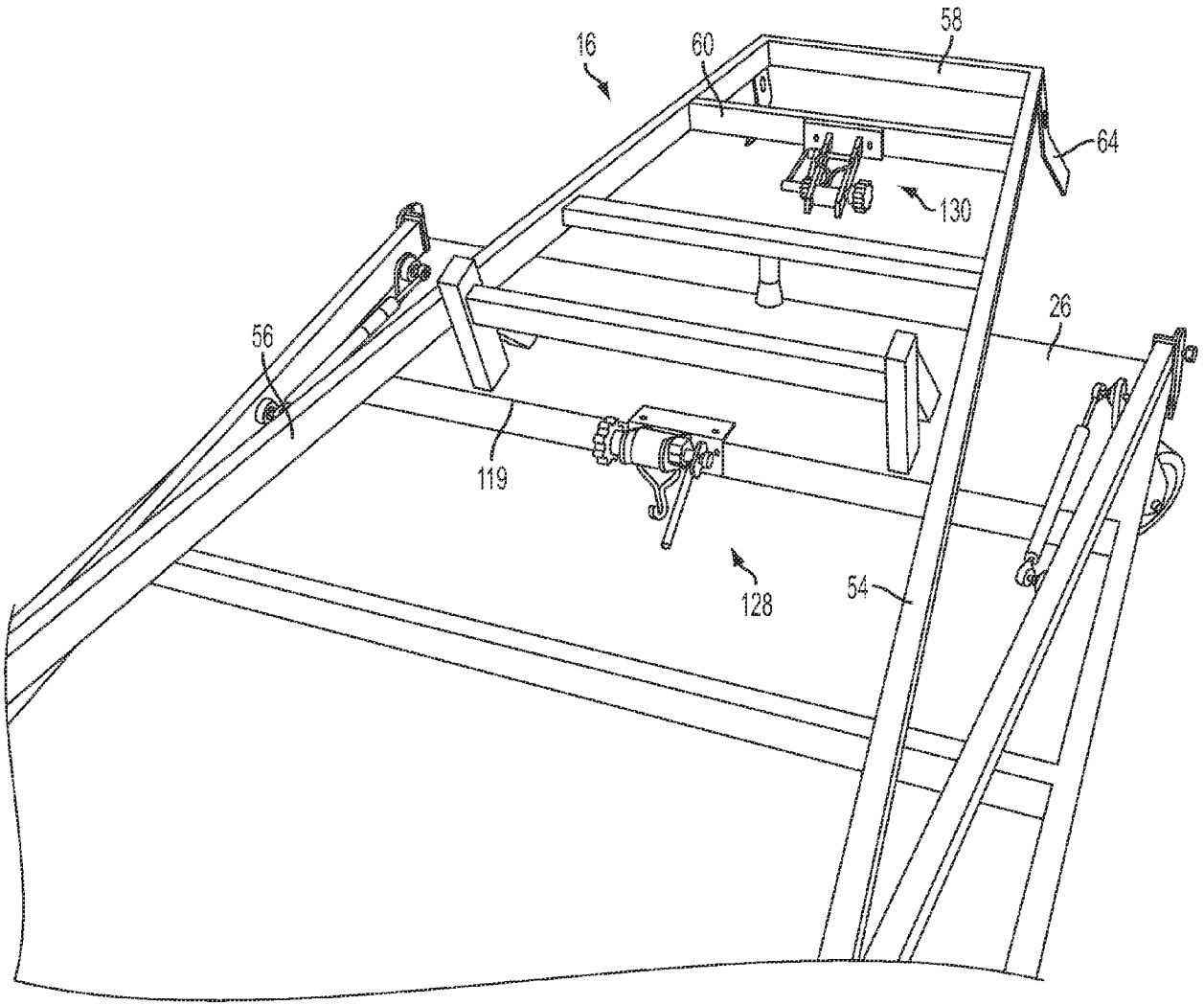
FIG. 12 is an enlarged perspective view of a second support frame of the ladder support device of FIG. 1 shown in a stored position.

After base section 114 of ladder 112 is positioned within stabilizing bracket 104, ladder 112 may be leaned against horizontal member 44 of top portion 38 of first support frame 14 and between arms 64, 66 of second support frame 16, as shown in FIG. 9. Arms 64, 66 may also limit or prevent lateral movement of ladder 112. As shown in FIGS. 5 and 7, treads 120 may be applied to horizontal member 44 and horizontal brace 110 to increase friction and thus further reduce relative movement between ladder 112 and ladder support device 10. FIGS. 10 and 11 provide additional views of ladder 112 supported on ladder support device 10.

Notably, ladder support device 10 is preferably configured to support ladder 112 at the appropriate angle for safe usage recommended by the manufacturer or required by a governmental regulation. For example, a governmental regulation may specify that a non-self-sustaining ladder should be placed at an angle of no more than 75 degrees measured from the horizontal. In this case, the dimensions D and H of ladder support device 10 are preferably selected such that ladder 112 is supported at an angle of no more than 75 degrees.

Similarly, according to further embodiments, ladder support device 10 preferably supports ladder 112 at an angle such that, even where a user is at the top of ladder 112, the user will in most or all cases be above (i.e., within) the wheelbase of ladder support device 10. It will be appreciated that this may reduce the risk that ladder support device 10 will tip during use.

The ladder support device according to embodiments of the present invention also facilitates length adjustments of a non-self-sustaining ladder. For example, ladder 112 may also comprise a fly section 122 slidably connected to base section 114 and having parallel rails 124, 126. As those of skill in the art will appreciate, where ladder 112 is used without ladder support device 10, base section 114 typically does not contact the vertical support against which ladder 112 is placed. Rather, rails 124, 126 of fly section 122 typically contact the vertical support. In this case, however, where the length of fly section 122 requires adjustment, a user must support base section 114 while at the same time raising or lowering fly section 122. This process is often cumbersome. In contrast, when ladder 112 is used with ladder support device 10, as shown in FIG. 9, rails 116, 118 of base section 114 are supported by horizontal member 44, but rails 124, 126 of fly section 122 are free. Thus, a user may stand on platform 26 and readily adjust the extension of fly section 122 without having to support base section 114. Additionally, because base section 114 is supported, ladder support device 10 may prevent bowing of ladder 112 that may otherwise occur without the use of ladder support device 10.

Figure 13:
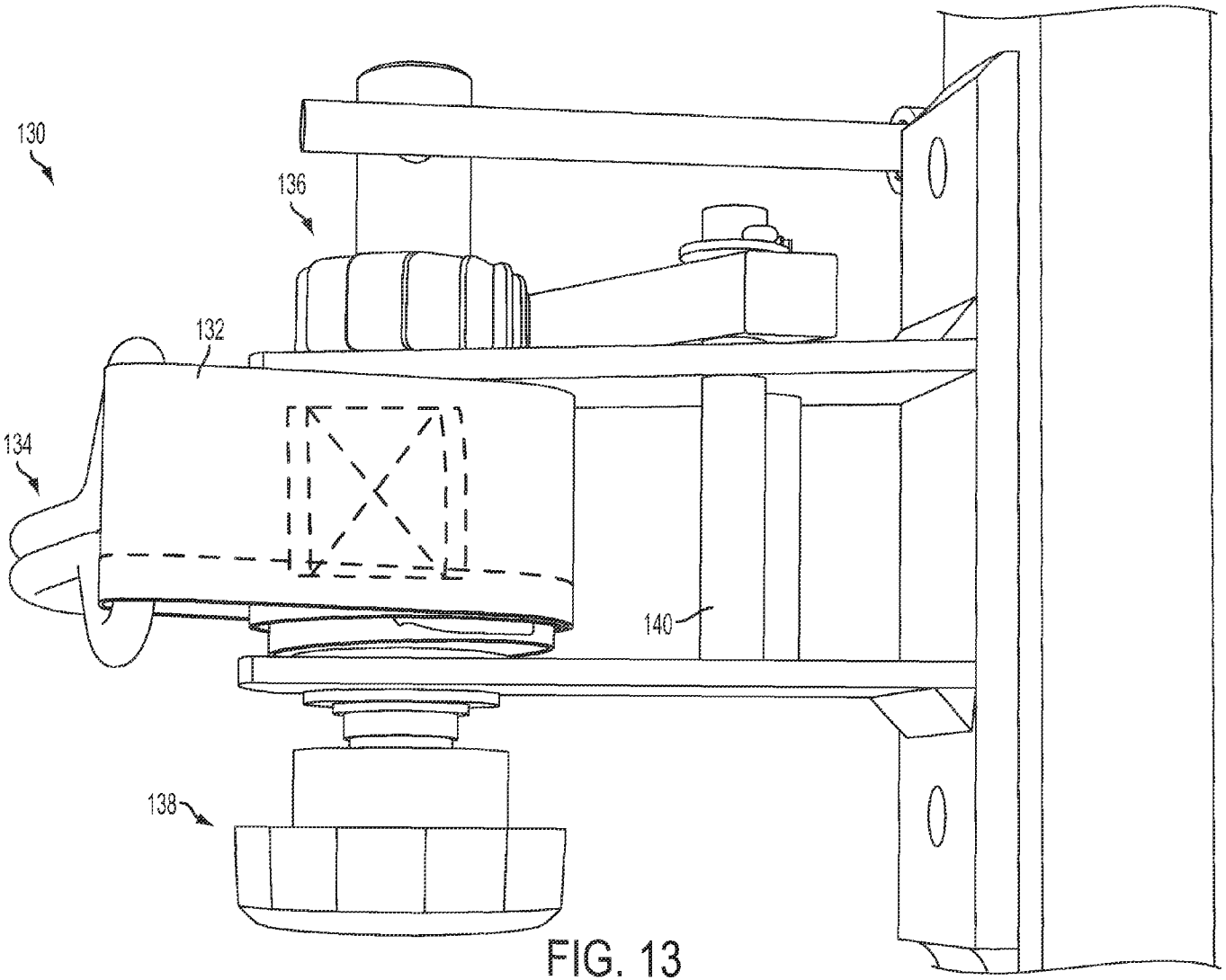
FIG. 13 is a top view of a tie down mechanism which may be used with embodiments of the present invention.

According to a further embodiment, and referring now also to FIGS. 12-18, ladder support device 10 may comprise one or more tie down mechanisms which may be used to secure a non-self-sustaining ladder to ladder support device 10. For example, ladder support device 10 may comprise two tie down mechanisms 128, 130. As shown, tie down mechanism 128 may be coupled to distal edge 119 of horizontal platform 26, and tie down mechanism 130 may be coupled with first support member 60 of second support frame 16. Although only tie down mechanism 130 is illustrated in FIG. 13 for ease of explanation, both of tie down mechanisms 128, 130 may preferably comprise a strap 132 coupled with a hook 134. A ratchet 136 comprising a gear and pawl may be used to lock strap 132 in a desired position, and knob 138 may be used to wind strap 132. Tie down mechanisms 128, 130 may also comprise a crossbar 140 to which hook 134 may be releasably coupled. Those of skill in the art are familiar with other tie down mechanisms which may be suitable for use with ladder support device 10.

Figure 14:
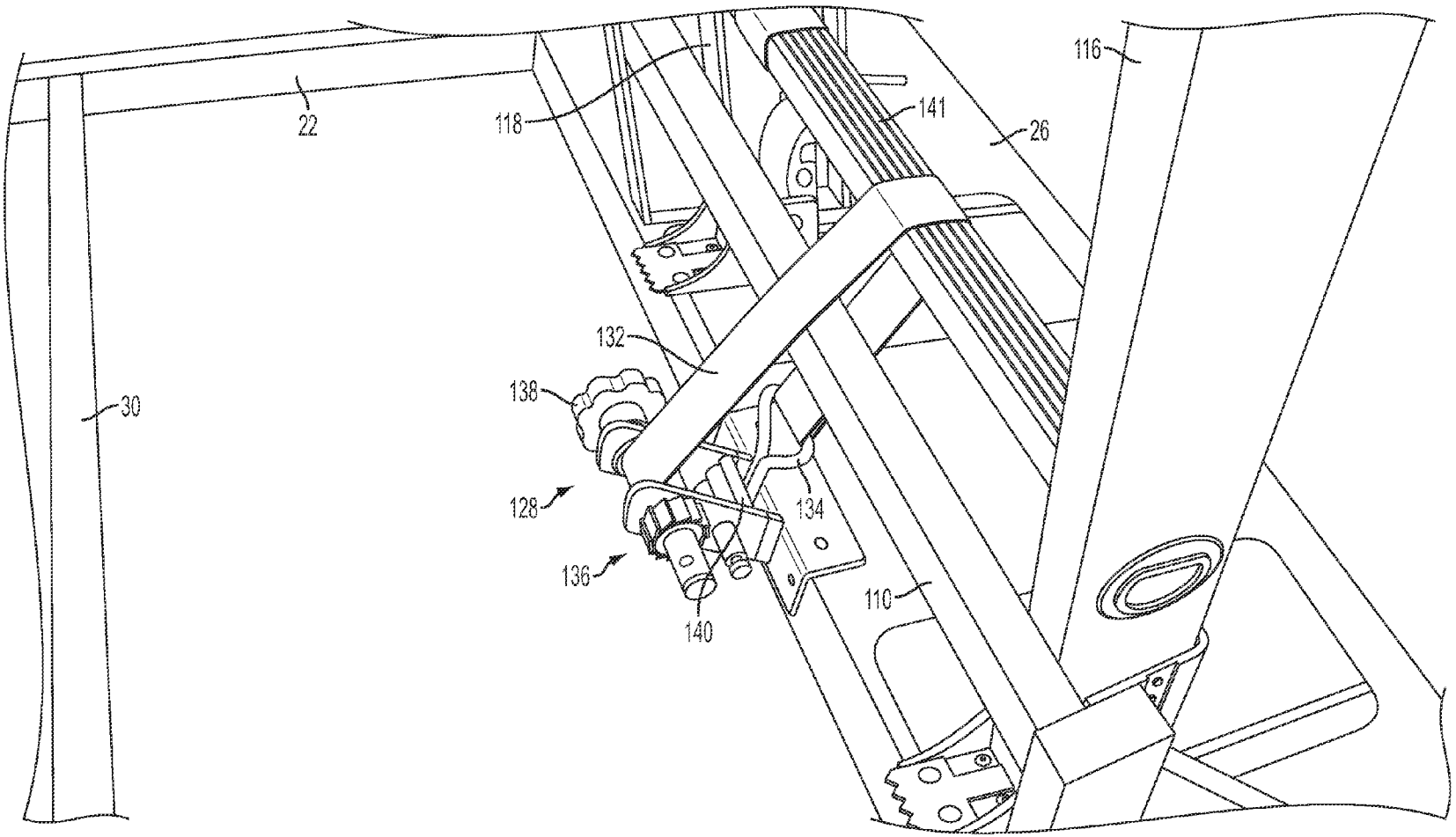
FIG. 14 is an enlarged perspective view of the stabilizing bracket of the ladder support device of FIG. 8 wherein a tie down mechanism is used to secure the extension ladder to the ladder support device.
Figure 15:
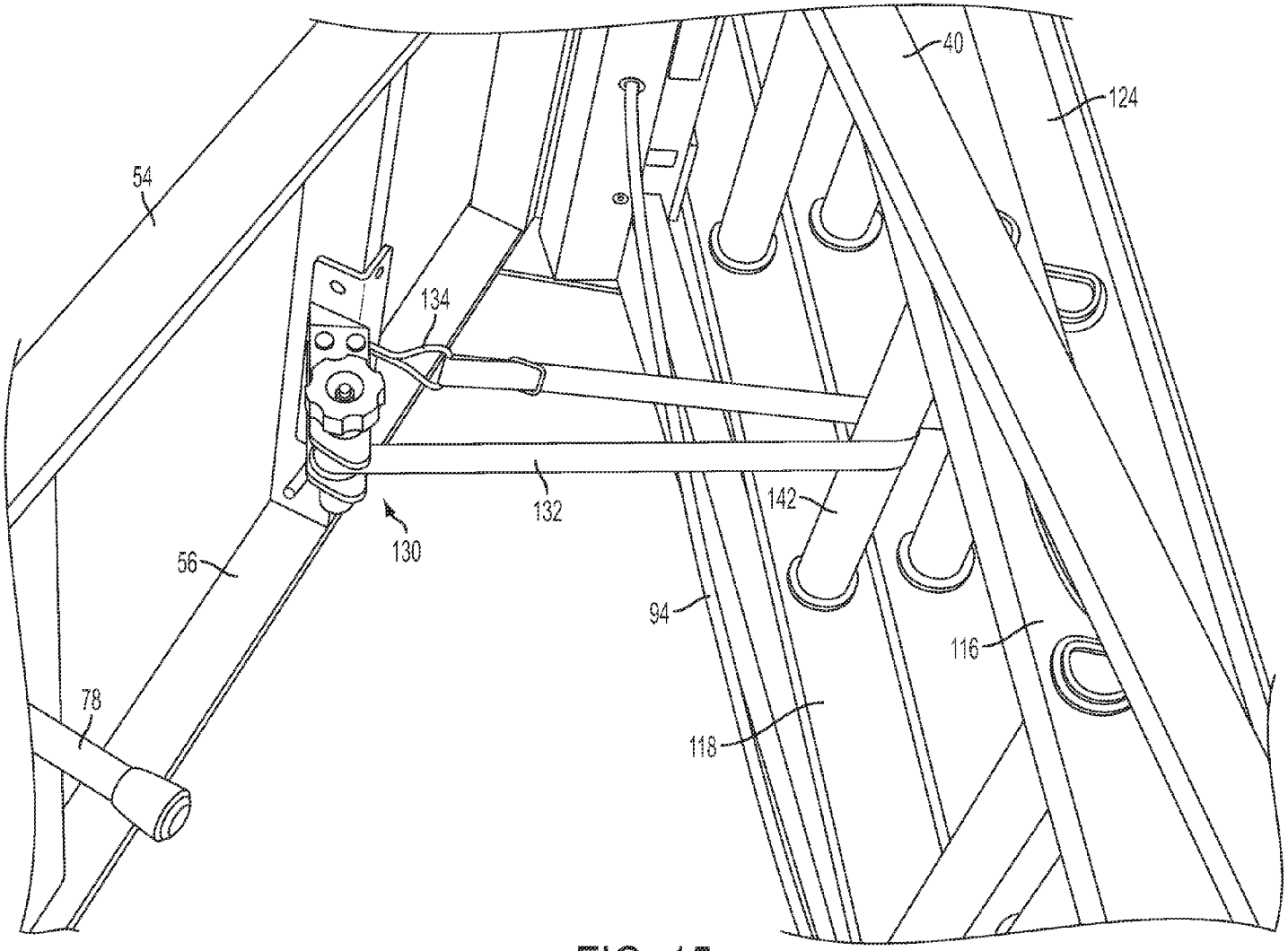
FIG. 15 is an enlarged perspective view of the top portions of the first and second support frames of the ladder support device of FIG. 8 wherein a tie down mechanism is used to secure the extension ladder to the ladder support device.

In one embodiment, as shown in FIG. 14, after ladder 112 is positioned on ladder support device 10, strap 132 of tie down mechanism 128 may be secured around a lower rung 141 of base section 114 and hook 134 secured to crossbar 140. Strap 132 may be tightened and locked in position using ratchet 136. Thus, the lower portion of base section 114 may be secured in place on ladder support device 10. Similarly, as shown in FIG. 15, strap 132 of tie down mechanism 130 may be secured around an upper rung 142 of base section 114. Again, strap 132 may be tightened and locked in position to secure the upper portion of base section 114 to ladder support device 10.

Figure 16:
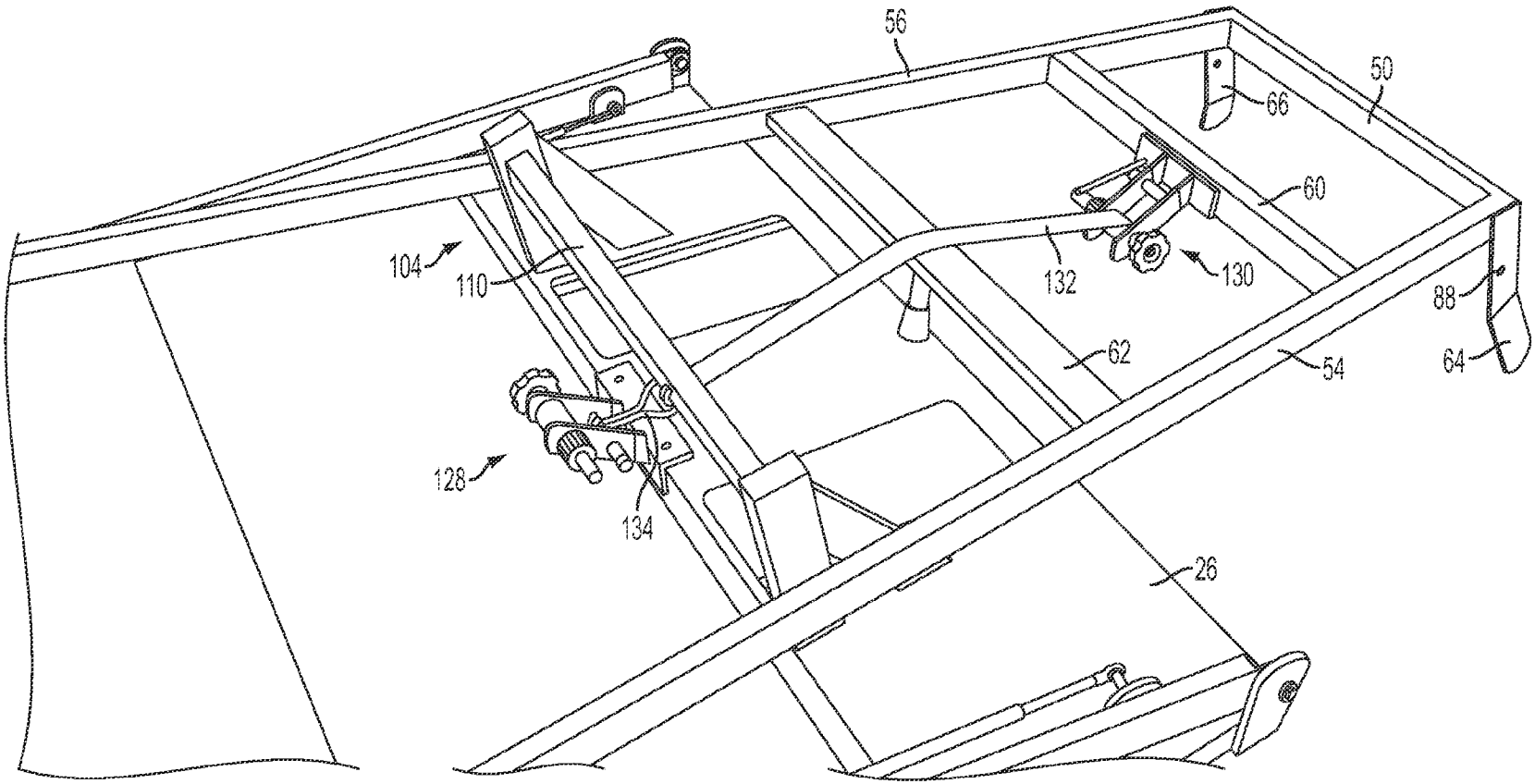
FIG. 16 is an enlarged perspective view of a second support frame of the ladder support device of FIG. 1 wherein a tie down mechanism is used to secure the second support frame to the base portion of the ladder support device.

Notably, tie down mechanism 130 may additionally be used to facilitate storage and transport of ladder support device 10. Referring to FIG. 16, when ladder support device 10 is in a stored position, strap 132 of tie down mechanism 130 may be extended over second support member 62 so that hook 134 of tie down mechanism 130 may be coupled with crossbar 140 of tie down mechanism 128. After strap 132 is tightened and locked in position, it will be appreciated that second support frame 16 is secured to base portion 12. As a result, first support frame 14, which lies under second support frame 16, is likewise secured to base portion 12.

Figure 17:
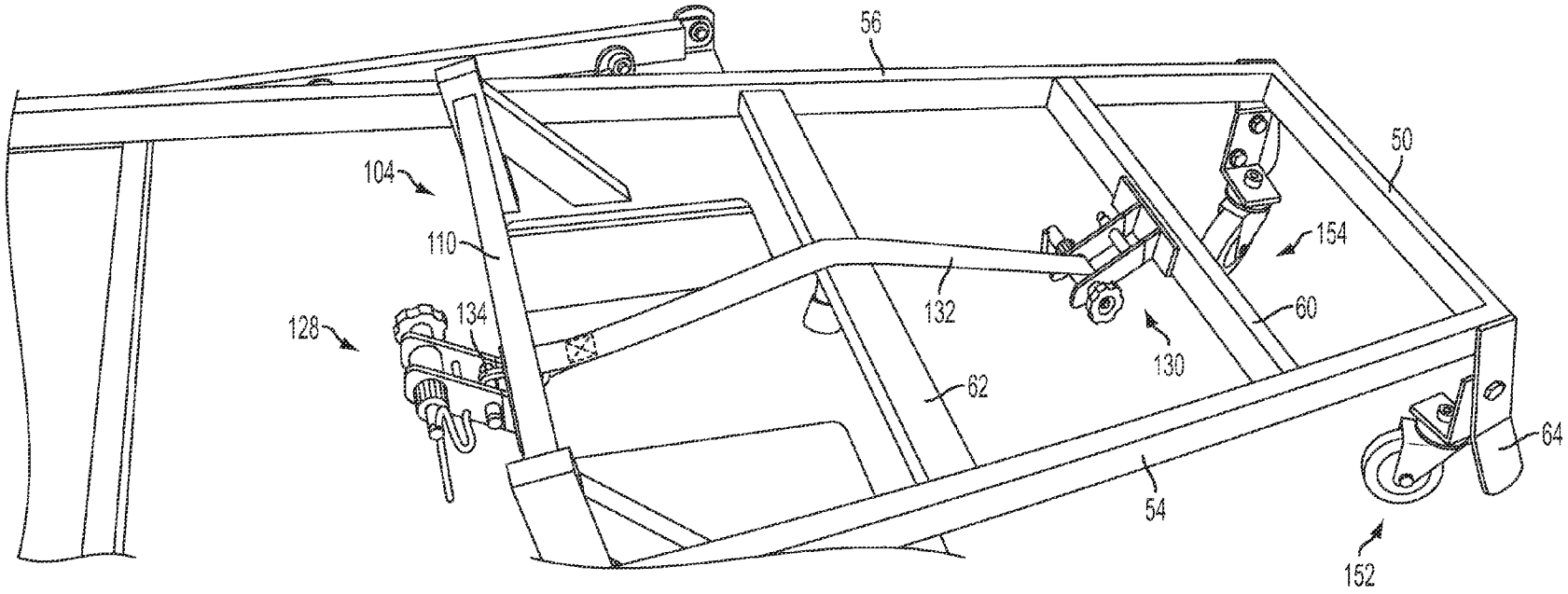
FIG. 17 is an enlarged perspective view of the ladder support device of FIG. 16 wherein casters are removably coupled with the arms of the second support frame.
Figure 18:
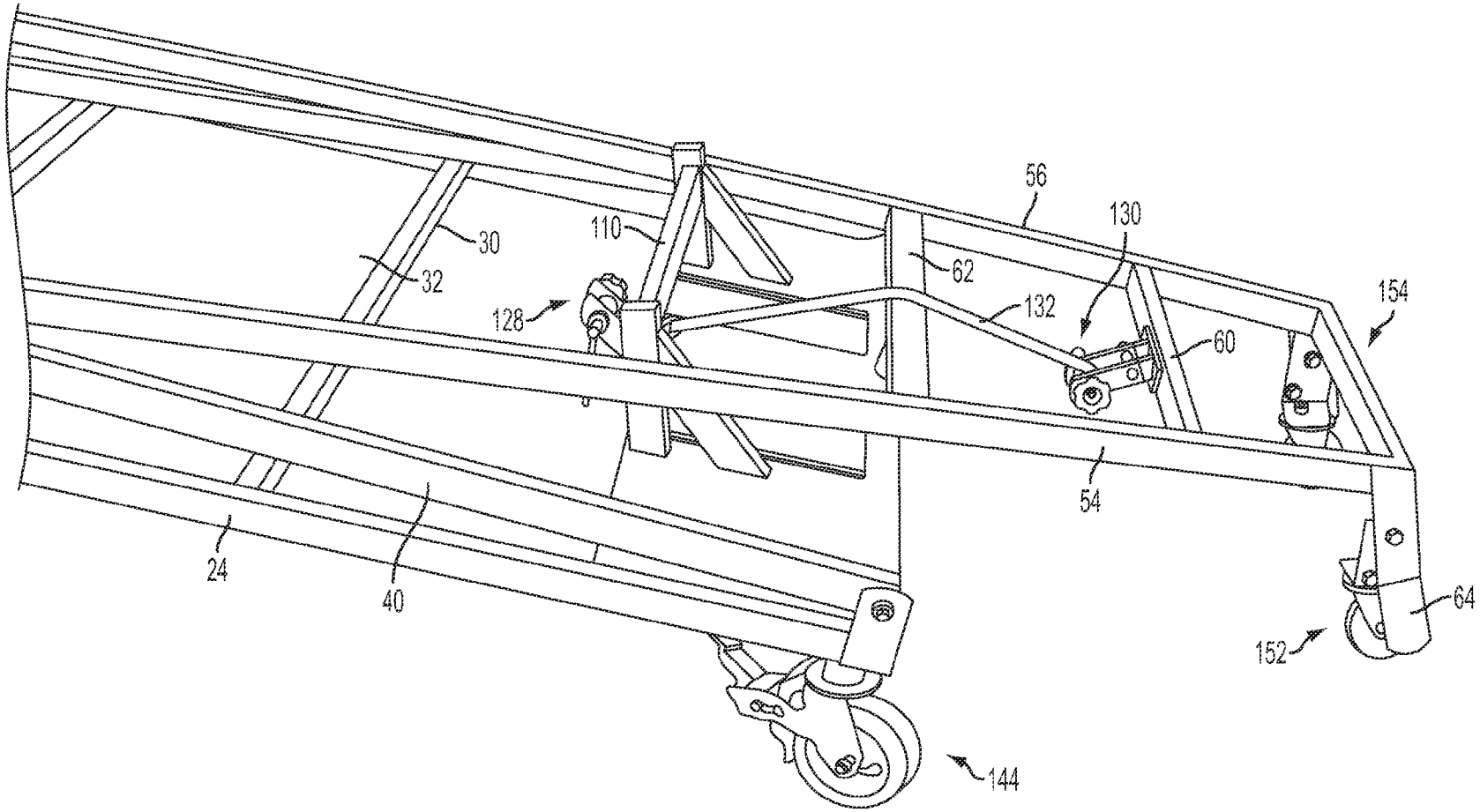
FIG. 18 is an enlarged perspective view of the ladder support device of FIG. 17 wherein the ladder support device is lifted for transport.

With first and second support frames 14, 16 prevented from pivoting with respect to base portion 12 via tie down mechanism 130, ladder support device 10 may be easily transported. As shown in the Figures, ladder support device 10 preferably comprises locking casters 144, 146, 148, 150 coupled with base portion 12 and respectively disposed generally below each elongate stile 40, 42, 54, 56. Casters 144, 146, 148, 150 may facilitate movement of ladder support device 10 to a desired position and may be locked in this position, as is well understood. According to a further embodiment, as shown in FIG. 17, an additional pair of casters 152, 154, preferably analogous to casters 144, 146, 148, 150, may be removably coupled with apertures 88, 90 of arms 64, 66 of second support frame 16. In this case, ladder support device 10 may comprise six casters. A user may then pick up top portion 38 of first support frame 14 such that casters 148, 150 are off of the ground and the casters in apertures 88, 90 are in contact with the ground. Thereby, the user may easily walk ladder support device 10 to a new location.

Further, in this configuration, ladder support device 10 may be readily loaded into and unloaded out of a truck. More particularly, the width of base portion 12 between side members 22, 24 is preferably sized to fit within a standard truck bed. Also, in the stored position, it is preferred that the length of ladder support device 10 between front member 18 of base portion 12 and horizontal member 44 of first support frame 14 (and vice versa) be sized to fit within a standard truck bed with the tailgate of the truck lowered. By virtue of tie down mechanism 130 tying first and second support frames 14, 16 down to base portion 12, a user may first lift first support frame 14 into the truck bed. The user may then lift second support frame 16 and push ladder support device 10 into the truck bed on casters 144, 146, 148, 150. Ladder support device 10 may then be secured in the truck bed with suitable straps, ropes, or the like.

It can thus be seen that the present invention provides a novel ladder support device for a non-self-sustaining ladder. While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A support device for a ladder, comprising:

a base portion having a horizontal platform carrying a stabilizing bracket for receiving legs of said ladder;

a first support frame comprising a proximal end and a distal end, said first support frame being pivotally connected to said base portion at said first support frame proximal end;

a second support frame comprising a proximal end and a distal end, said second support frame being pivotally connected to said base portion at said second support frame proximal end;

wherein said first support frame distal end is releasably connectable with said second support frame distal end;

a tether arrangement coupled to one of said first and second support frame distal ends for disconnecting said first and second support frames; and a pair of arms for receiving an upper portion of said ladder therebetween, said pair of arms projecting from one of said first and second support frame distal ends.

2. The support device of claim 1, wherein each of said arms defines an aperture sized to receive a spring-actuated pin extending from a lateral side of the other of said first and second support frame distal ends.

3. The support device of claim 2, wherein said tether arrangement is operative to actuate said spring-actuated pins to disconnect said first support frame from said second support frame.

4. The support device of claim 1, wherein said first and second support frames comprise a top portion and a pair of elongate stiles.

5. The support device of claim 1, further comprising at least one pneumatic cylinder extending between said base portion and each of said first and second support frames.

6. The support device of claim 1, further comprising casters coupled with said base portion to move said support device to a desired position.

7. The support device of claim 1, further comprising at least one tie down mechanism coupled with said support device to secure said ladder to said support device.

8. The support device of claim 1, wherein, upon disconnection of said first support frame from said second support frame, said first and second support frames are collapsible for storage.

9. A support device for a ladder, comprising:

a base portion having a horizontal platform carrying a stabilizing bracket for receiving legs of said ladder;

a first support frame coupled with said base portion, said first support frame comprising a top portion and a pair of elongate stiles;

a second support frame coupled with said base portion, said second support frame comprising a top portion and a pair of elongate stiles;

said first support frame and said second support frame each being pivotable relative to said base portion between a stored position and an extended position;

wherein in said extended position said first support frame top portion is releasably connected to said second support frame top portion;

a retractable locking mechanism for disconnecting said first support frame from said second support frame such that said first and second support frames may be pivoted to said stored position; and a pair of arms for receiving an upper portion of said ladder therebetween, said pair of arms projecting from the other of said first and second support frame top portion.

10. The support device of claim 9, wherein, upon disconnection of said first support frame from said second support frame, said first and second support frames are collapsible for storage.

11. The support device of claim 10, wherein in said stored position one of said first and second support frames is folded over the other of said first and second support frames such that said first and second support frames lie on said base portion.

12. The support device of claim 9, wherein said locking mechanism comprises a pair of spring-actuated pins extending from a lateral side of one of said first and second support frame top portions.

13. The support device of claim 12, further comprising a tether arrangement operatively connected to said spring-actuated pins for disconnecting said first support frame from said second support frame.

14. The support device of claim 9, further comprising at least one pneumatic cylinder extending between said base portion and each of said first and second support frames.

15. The support device of claim 9, further comprising casters coupled with said base portion to move said support device to a desired position.

16. The support device of claim 9, further comprising at least one tie down mechanism coupled with said support device to secure said ladder to said support device.

* * * * *